US009296577B2

(12) United States Patent
Höpner et al.

(10) Patent No.: US 9,296,577 B2
(45) Date of Patent: Mar. 29, 2016

(54) SUPPLEMENT FEEDER FOR FLAT OBJECTS

(71) Applicant: BÖWE SYSTEC GmbH, Augsburg (DE)

(72) Inventors: Bernd Höpner, Augsburg (DE); Ronald Celeste, Kühlenthal (DE); Florian Hölzle, Augsburg (DE)

(73) Assignee: BÖWE SYSTEC GMBH, Augsburg (DE)

( * ) Notice: Subject to any disclaimer, the term of this patent is extended or adjusted under 35 U.S.C. 154(b) by 0 days.

(21) Appl. No.: 14/308,237

(22) Filed: Jun. 18, 2014

(65) Prior Publication Data

US 2015/0014920 A1 Jan. 15, 2015

(30) Foreign Application Priority Data

Jun. 21, 2013 (DE) ..... 10 2013 106 483

(51) Int. Cl.

| | |
|---|---|
| ***B65H 3/24*** | (2006.01) |
| ***B65H 3/04*** | (2006.01) |
| ***B65H 3/62*** | (2006.01) |
| ***B65H 3/66*** | (2006.01) |

(52) U.S. Cl.

CPC ..... *B65H 3/24* (2013.01); *B65H 3/042* (2013.01); *B65H 3/62* (2013.01); *B65H 3/66* (2013.01); *B65H 2405/1122* (2013.01); *B65H 2513/50* (2013.01); *B65H 2555/10* (2013.01); *B65H 2701/1932* (2013.01)

(58) Field of Classification Search

CPC ..... B65H 3/042; B65H 3/24; B65H 3/242; B65H 3/62; B65H 2405/1122; B65H 1/06; B65H 3/063; B65H 3/46; B65H 3/523; B65H 3/5246; B65H 3/5276; B65H 3/60

USPC ..... 271/35, 210, 221, 42, 128

See application file for complete search history.

(56) References Cited

U.S. PATENT DOCUMENTS 2,626,147 A * 1/1953 Gjostein ..... 271/8.1
3,545,741 A 12/1970 Porth (Continued)

FOREIGN PATENT DOCUMENTS

| | | |
|---|---|---|
| DE | 1178444 | 9/1964 |
| DE | 1263027 | 3/1968 |
| DE | 1812960 | 11/1970 |

*Primary Examiner* — Michael McCullough

(74) *Attorney, Agent, or Firm* — Paul D. Bianco; Fleit Gibbons Gutman Bongini & Bianco PL

(57) ABSTRACT

A supplement feeder for flat objects, comprising a receiving device with a stack compartment for receiving objects in the form of a stack, and a takeoff device for taking off individual objects from the stack, wherein the stack compartment has a front contact region against which the front edge of the stack rests, and equipped with guiding elements for guiding and shaping the stack, comprising a stack shoe that is arranged at the rear edge of the stack in order to guide the stack in the direction of the front contact region. According to the disclosure, this supplement feeder is equipped with a takeoff device for taking off individual objects from the object stack, and at least one component of the guiding elements, and in particular the stack shoe, is coupled to a knocking unit that transmits a discrete knock impact onto the respective component of the guiding element. Thereby malfunctions in the form of missed takeoffs or multiple takeoffs when taking off objects can be largely avoided.

16 Claims, 11 Drawing Sheets

(56) References Cited

U.S. PATENT DOCUMENTS 3,551,298 A 12/1970 Lichtenstein
6,695,304 B1 * 2/2004 Werner ..... 271/146
6,698,748 B1 * 3/2004 Crowley ..... 271/98

* cited by examiner

SUPPLEMENT FEEDER FOR FLAT OBJECTS

CROSS REFERENCE TO RELATED APPLICATION

This application claims priority under 35 U.S.C. §119 to German Patent Application No. 10 2013 106 483.3 filed 21 Jun. 2013, the entire contents of which are incorporated herein by reference.

FIELD OF THE DISCLOSURE

The disclosure relates to a supplement feeder for flat objects.

BACKGROUND OF THE DISCLOSURE

A device for loosening sheets of paper lying vertically one on top of another in a stack and that can be used in a combination line (combination machine) is known from DE 1263027. The device comprises an inclined stack support table on which the stack rests. In order to loosen the sheets and perform a pre-separation of the sheets in the stack, the stack support table is caused to vibrate in the offsetting direction and perpendicular to the sheet plane. For this purpose, the stack support table is elastically supported and is indirectly or directly connected to a vibration oscillation generator. The vibration oscillation generator can be adjusted to a suitable oscillation frequency, e.g. 50 Hz. At its output end, the stack support table has a bend in the shape of a sled runner, which is inclined slightly upward. A feed roller and a retarding roller adjoin this runner-like bend, a gap being formed between them, through which single sheets from the paper stack can be guided. Due to the vibrations that are transmitted by the vibration oscillation generator to the stack support table, the uppermost sheets of the paper stack move according to the micro-throw principle in the direction of the gap between the feed roller and the retarding roller. The pulse magnitude and number of vibrations that are transmitted from the vibration oscillation generator to the stack support table can be adjusted such that the sheets of the paper stack are fed in an uninterrupted flow to the gap and can be led through the gap individually. The gap width can be adjusted to the paper thickness. The sled runner-shaped bend at the output end causes a loosening effect when the sheets arrive, wherein the uppermost sheet first reaches the gap in order to be seized by the driven feed roller and pulled through the gap.

A device for removing individual sheets from a stack and for transporting the taken-off sheets is known from DE 1 178 444, comprising a unit for receiving the stack in an upward-tilted position and a conveying device with which the underside of the respective lowest sheet in the stack is seized. To facilitate the takeoff of the lowest sheet, the stack is vibrated by a vibration device that communicates upward and downward vibrations to the stack table. The lowest sheet, which is taken from the stack, is led by the conveying device through a roller.

It has been found in these known devices that the vibration movement that is transmitted by vibrators or vibration generators to the stack support table causes micro jumps of the individual sheets. These micro jumps cause a movement in the direction of the output end of the support table in which a takeoff device, in the form of a roller nip for example, is arranged for taking individual sheets from the stack. The micro jumps can lead to jamming of objects in the roller nip. The vibration movement also leads to a compression of the stack in the lower area. Jams of objects in the roller nip and a compression of the stack, however, frequently lead to malfunctions in removing the sheets, because several sheets are fed simultaneously through the takeoff device and this results in doubled or multiple takeoffs.

SUMMARY OF THE DISCLOSURE

The disclosure therefore addresses the problem of presenting a receiving device for flat objects, which can be used in particular in a supplement feeder, and which enables a reliable separation of the objects when being taken from the object stack, without the possibility of a compression of the stacked objects in the stack occurring. Another problem is to provide a supplement feeder having a receiving device for a stack of flat objects, in which malfunctions in the form of faulty or multiple takeoffs are largely avoided.

These problems are solved with a receiving device for flat objects having the features as disclosed herein and with a supplement feeder having such a receiving device. Preferred embodiments of the receiving device and/or the supplement feeder are also disclosed.

The receiving device according to the disclosure comprises a stack compartment for receiving flat objects in the form of a stack, wherein the stack compartment has a front contact region against which the front edge of the stack makes contact. The receiving device according to the disclosure further comprises guiding elements for guiding and shaping the stack. The guiding elements comprise guide rails, for example, which are arranged at the front contact region of the stack compartment and form a stop for the front edge of the stack. The guiding elements can further comprise a stack shoe arranged at the rear edge of the stack, with which the stack is guided in the direction of the front contact region.

In order to prevent an adhesion of the objects in the stack and to achieve a best possible loosening of the objects in the stack and thereby a best possible uniform takeoff force when taking the individual objects from the object stack, at least one component of the guiding elements, i.e. the stack shoe or the guide rails, for example, is provided with a knocking unit that transmits a discrete knock impact onto the respective guiding element. Such knock impacts are expediently transmitted at defined time intervals to at least one component of the guiding elements.

The objects resting one atop another in the stack are loosened by the knock impact and adhesion of the objects due to adhesive frictional forces is prevented. Differently from known devices of the prior art, however, the objects are not loosened in the object stack by transmission of continuous vibrations onto a stack support, but rather by discrete knock impacts, which are preferably transmitted at defined time intervals to the guide element or elements. The knock impacts loosen the objects of the stack over the entire base surface of the stack uniformly in order to prevent adhesion of the objects to one another, without a compression of the stack in the front contact region due to micro jumps of the objects. Thereby a uniform takeoff force, with which the object can be pulled individually from the stack by means of the takeoff unit, can be guaranteed. Due to the constant takeoff force, which is substantially independent of the height of the stack, malfunctions while taking the objects off the stack resulting from missed takeoffs or double or multiple takeoffs can be prevented.

The knocking unit, with which the discrete knock impacts can be transmitted to the guiding element or one of the guiding elements, expediently comprises a movable weight or a hammer or a piston, which is moved at high speed against the respective guiding element. The knock impact transmitted from the movable piston to the respective guiding element is transmitted by the guiding element onto the stack in contact therewith and leads to a loosening of the objects in the stack. In order to transmit the discrete knock impact, the movable weight of the knocking unit can be driven pneumatically, hydraulically or also by a tension spring or electric motor such as an electrically driven cam motor or a linear motor.

Preferably discrete knock impacts are transmitted continuously and at defined points in time to the respective guiding element by means of the knocking unit, the defined points in time preferably being equidistant. The equidistant points in time can have a temporal spacing of 0.1-10 seconds for example, more particularly 0.5-5 seconds, and preferably approximately 1 second.

To guarantee a reliable feeding of objects to be taken off the stack to a takeoff device adjoining the receiving device for the supplement feeder, the receiving device expediently has an inclined bottom on which the stack is supported, wherein the inclination of the bottom relative to the horizontal plane is preferably adjustable by means of a pivoting mechanism. The bottom of the feeder can also be oriented horizontally, however. In this case, the feeder is installed in an inclined position or built into a combination line so that the front edge of the stack can be supported on the guide rails which are thereby inclined relative to the vertical.

The guiding elements preferably comprise a removable stack shoe that is arranged at the rear edge of the stack in order to guide the stack in the direction of the front contact region. The stack shoe expediently has a stack surface on which the rear edge of the lowermost objects of the stack rest and that is inclined in the direction of the front contact region. This has the effect that the stack is shaped and is pressed in the direction of the front contact region of the receiving device. The front contact region of the receiving device has a contact surface running substantially vertically and an inclined surface adjoining the contact surface in the direction of the bottom of the stack compartment and preferably running parallel to the stack surface. This enables an offset stacking of the objects in the lower region of the object stack. This offset stacking of the objects in the lower stack region leads to a pre-separation of the objects and facilitates the individual takeoff of the objects from the stack by means of a takeoff unit adjoining the receiving device. The contact surface in the front contact region of the receiving device is expediently formed by guiding elements in the form of guide rails extending upward substantially perpendicular to the base.

In an additional embodiment of the receiving device according to the disclosure, the knocking unit is fixed directly to one of the guiding elements. Thus the knocking unit can be fixed directly to a rear side of the stack shoe, for example. In this embodiment, the knocking unit has a housing in which a piston driven pneumatically or hydraulically, for example, is movably arranged. The piston is moved by the drive against an end face housing wall in order to transmit a discrete knock impact to the guiding element connected to the piston.

The receiving device according to the disclosure is suitable particularly for use in a supplement feeder for flat objects that comprises, in addition to the receiving device with the object stack, a takeoff device for taking individual objects from the stack. The takeoff device is generally operated cyclically with a predetermined cycle frequency (number of objects taken from the stack per unit time) in order to take individual objects from the stack. The repetition rate with which the knocking unit transmits a discrete knock impact to the guiding element is expediently adapted to the cycle frequency of the takeoff device and is less than this cycle frequency, particularly by a factor of 5-10, i.e. a discrete knock impact is transmitted to the guiding element after the takeoff of 5-10 objects from the object stack.

BRIEF DESCRIPTION OF THE DRAWINGS

These and other advantages of the receiving device according to the disclosure can be deduced from the embodiments described in detail below, with reference to the accompanying drawings. These embodiments show the use of the receiving device according to the disclosure in a feeder for flat objects, as is used, for example, in combination lines for mail pieces. The application of the receiving device according to the disclosure is not limited to this application case, however, but also comprises the use in other paper-processing machines such as copiers, printers, fax devices, etc., in which flat objects are received in a stack form. The drawings show.

DETAILED DESCRIPTION OF THE DISCLOSURE

Figure 1:
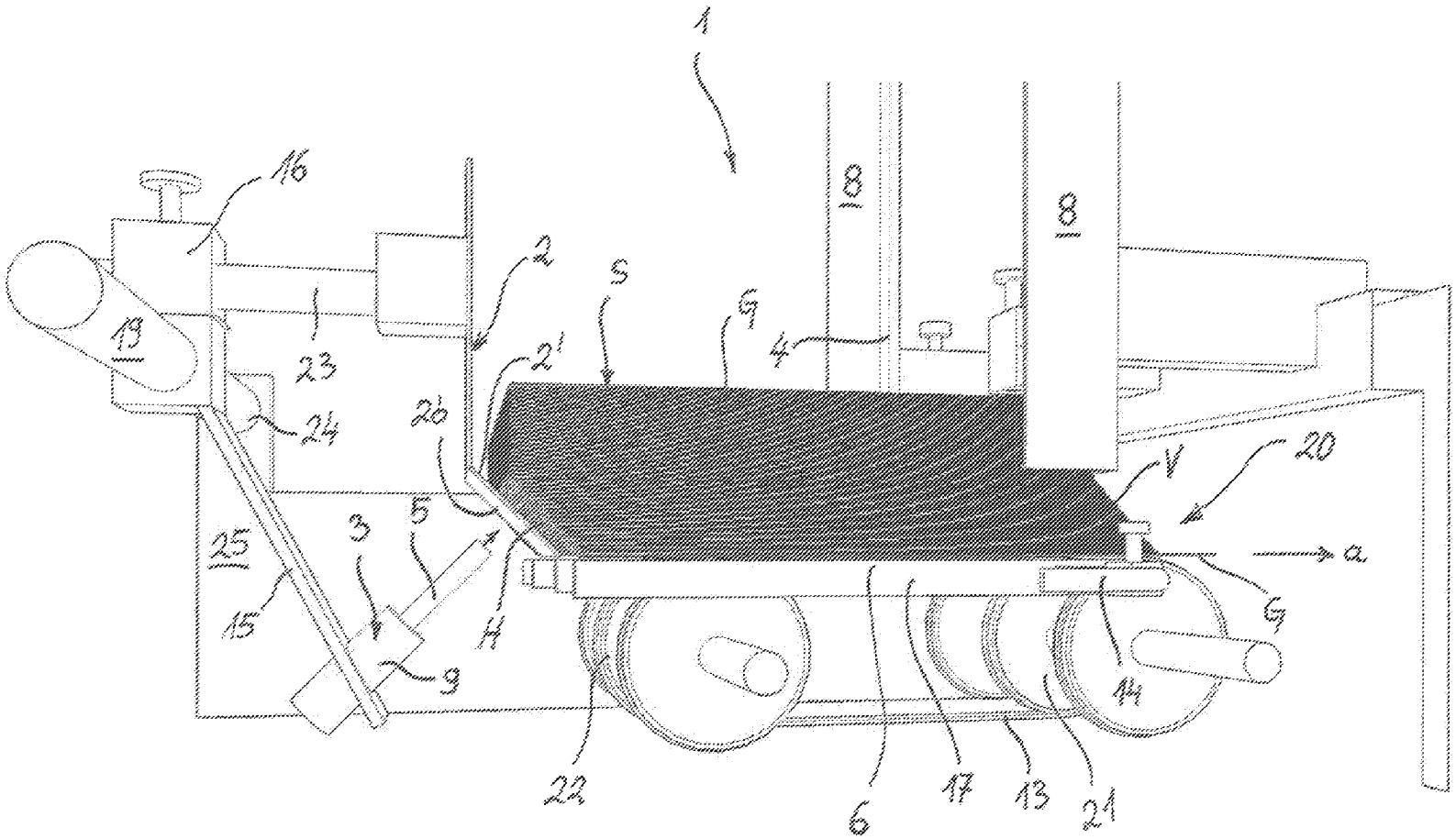
FIG. 1: schematic representation in a perspective side view of a supplement feeder with a receiving device according to the disclosure in a first embodiment.

The embodiment of a feeder for flat objects G shown in a side view in FIG. 1 comprises a receiving device according to the disclosure with a stack compartment 1 for receiving the objects G in the form of a stack S. The objects G to be processed are stacked one atop another in the stack compartment 1. The objects G can be individual sheets of paper or cardboard. The objects can also be folded sheets or envelopes. The objects G contained in the stack compartment 1 are deposited by the feeder on a combination line, not drawn here, in collecting compartments there and are subsequently fed into an enveloping machine which then places the objects combined in a collecting compartment into an envelope.

The feeder comprises a takeoff device 20 for taking individual objects G from the stack S. The takeoff device comprises a conveying element that takes the lowest object G out of the stack S and transports it along a takeoff direction. The conveying element comprises, for example, a driven belt 13 such as a friction belt or a suction belt, which is guided over rollers 21, 22.

Figure 3:
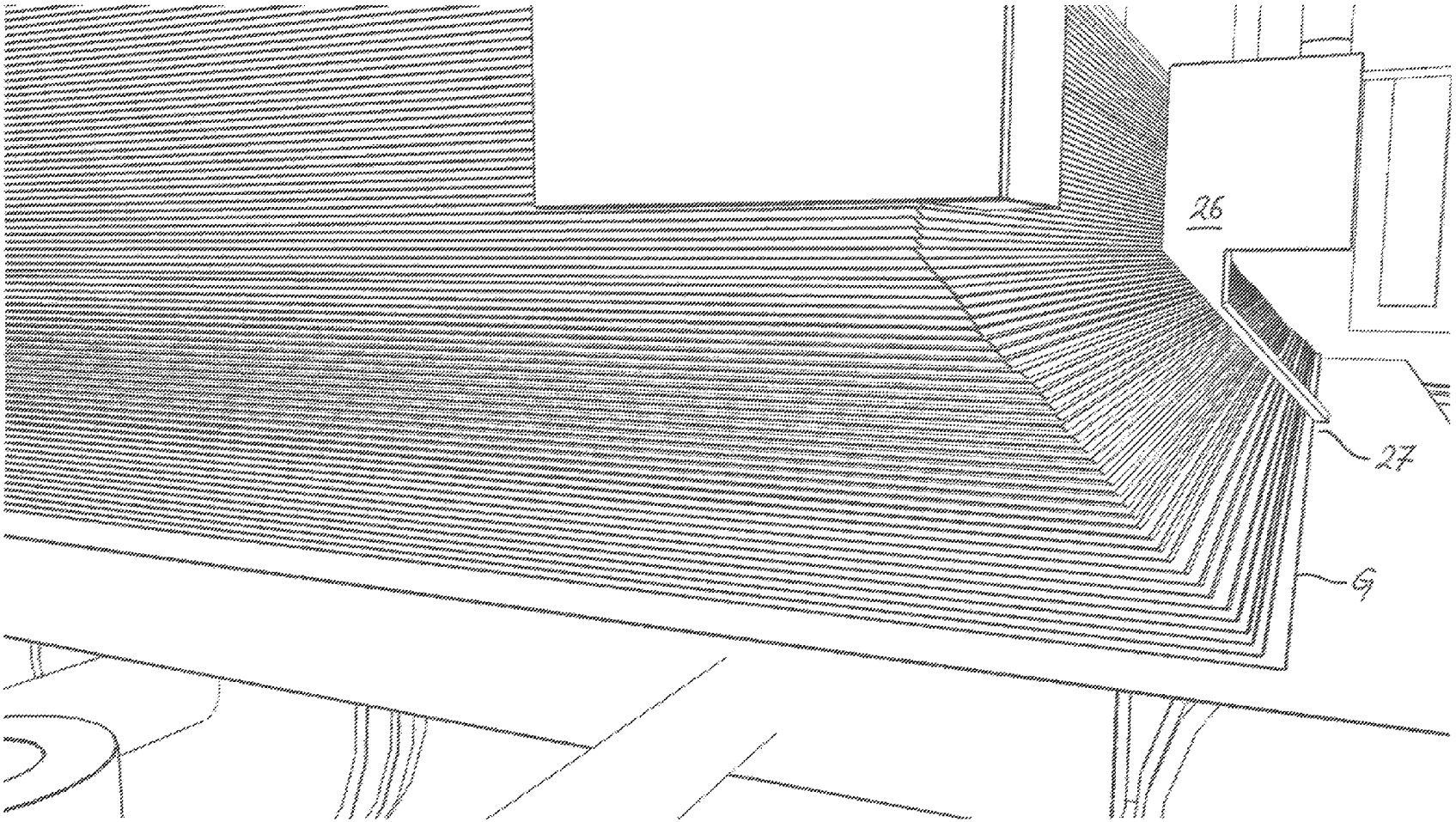
FIG. 3: detail view of the gate of the feeder in FIG. 1.

The feeder drawn in FIG. 1 additionally has a gate shown in detail in FIG. 3, with a gate element 26 which, together with the conveying element (belt 13) forms a gate gap 27, through which an object G taken from the stack S as can be led individually. The gate element 26 has a forward-inclined oblique surface, which forms an inclined stop surface relative to the conveying surface of the conveying element for the lower area of the front edge V of the stack S and leads to a wedge-shaped offsetting of the objects in the lower area of the stack S, as shown in FIG. 3.

The receiving device of the feeder in FIG. 1 has a front contact region 4, against which the front edge V of the stack S rests, and comprises guiding elements 2, 8 for guiding and shaping the stack S deposited in the stack compartment 1. In the embodiment of the receiving device according to the disclosure illustrated in FIG. 1, the guiding elements comprise two guide rails 8, positioned substantially vertically, and a stack shoe 2. The guide rails 8, which have an L-shaped cross section, are arranged at the front contact region 4 of the receiving device and form a stop for the front edge V of the upper area of the stack S. The stack shoe 2 is arranged at the rear edge of the stack S. The stack shoe 2 has an inclined stack surface 2' inclined in the direction of the front contact region 4. The rear edge of the lowermost objects G of the stack S rests on the inclined stack surface 12', whereby the lowermost objects G of the stack S are pressed in the direction of the front contact region 4. This results in a shaping and guidance of the stack S with a wedge-like stack shape in the lower area of the stack, as shown in FIG. 1.

The stack compartment 1 further comprises a base 6 on which the stack S rests and which is adjustably inclined relative to the horizontal plane. The base 6 in the illustrated embodiment is formed by a pivotable grate 17 or a pivotable plate. The upper run of the belt 13 runs between the arms of the grate 17. The contact surface of the lowermost object G on the conveying service of the belt 13 can be adjusted by means of the stack shoe 12. By raising the stack shoe 12 in relation to the conveying surface of the conveying element, the area of the rear edge H of the stack S is lifted off the conveying surface of the conveying element (belt 13) such that only the front region around the front edge V of the stack S contacts the conveying surface of the belt 13. Thus, the takeoff force of the conveying element can be varied by lifting or lowering the stack shoe 12. In order to adapt the takeoff force of the conveying element, the stack shoe 12 is expediently arranged movably on a frame part 16.

Figure 4:
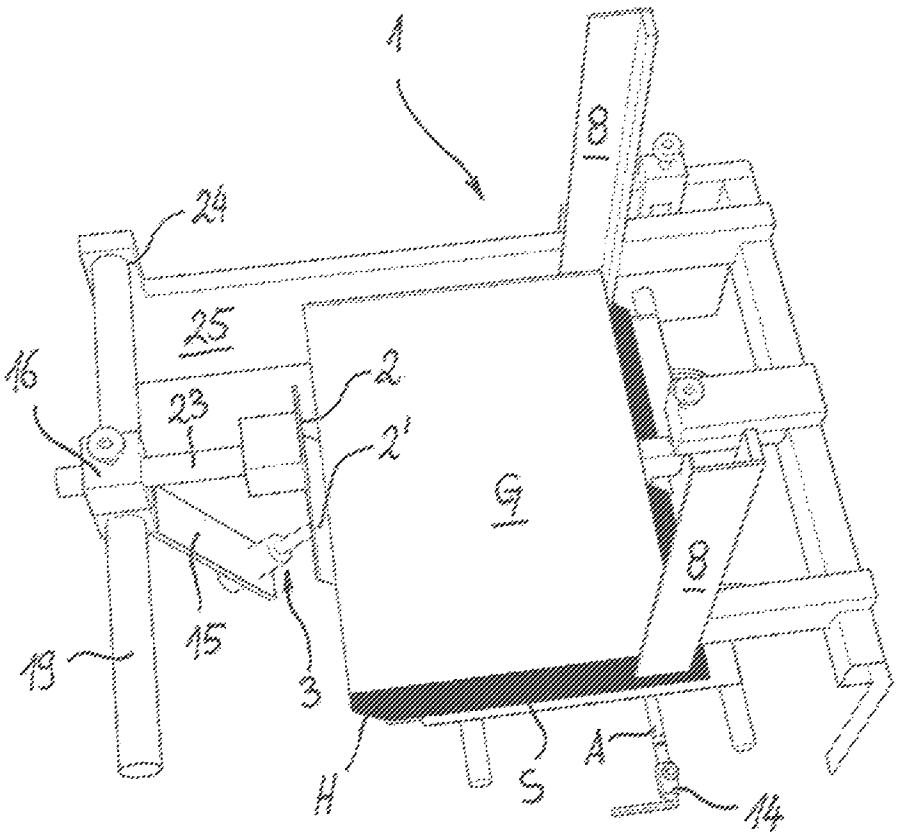
FIG. 4: plan view of the feeder in FIG. 1.

To adjust the inclination of the base 6, the grate 17 or the contact plate is pivotable about a pivot axis A (FIG. 4) and is coupled to a lifting device. The lifting device comprises a cam 14 that can be adjusted and fixed in different positions.

By pivoting the grate 17 by means of the cam 14, the takeoff force of the conveying element on the lowest object and the point of attack of the conveying element can be adjusted and adapted to the properties of the objects G. The larger the inclination of the base 6 in relation to the conveying surface of the conveying element, the farther the point of attack of the conveying element is shifted in the direction of the front contact region 4 of the receiving device. This is particularly advantageous when processing thin sheets, which can be easily bent in the center area when being lifted by the stack shoe 12. The objects G experience a support by the pivotable grate 17, which counteracts the bending.

A knocking unit 3, with which discrete knock impacts can be transmitted to the rear side 2*b* of the stack shoe, is arranged on the rear side 2*b* of the stack shoe 2. The knocking unit 3 is fixed via a retaining rod 15 to a pivotable shaft 19. The frame part 16 on which the stack shoe 2 is movably arranged via a push rod 23 is also fixed to the pivotable shaft 19. The shaft 19 is rotatably mounted in a bearing assembly 24, wherein the bearings of the bearing assembly 24 are arranged in stationary side parts 25. The front side part is not shown in the drawing in FIG. 1 for reasons of clarity.

Figure 2:
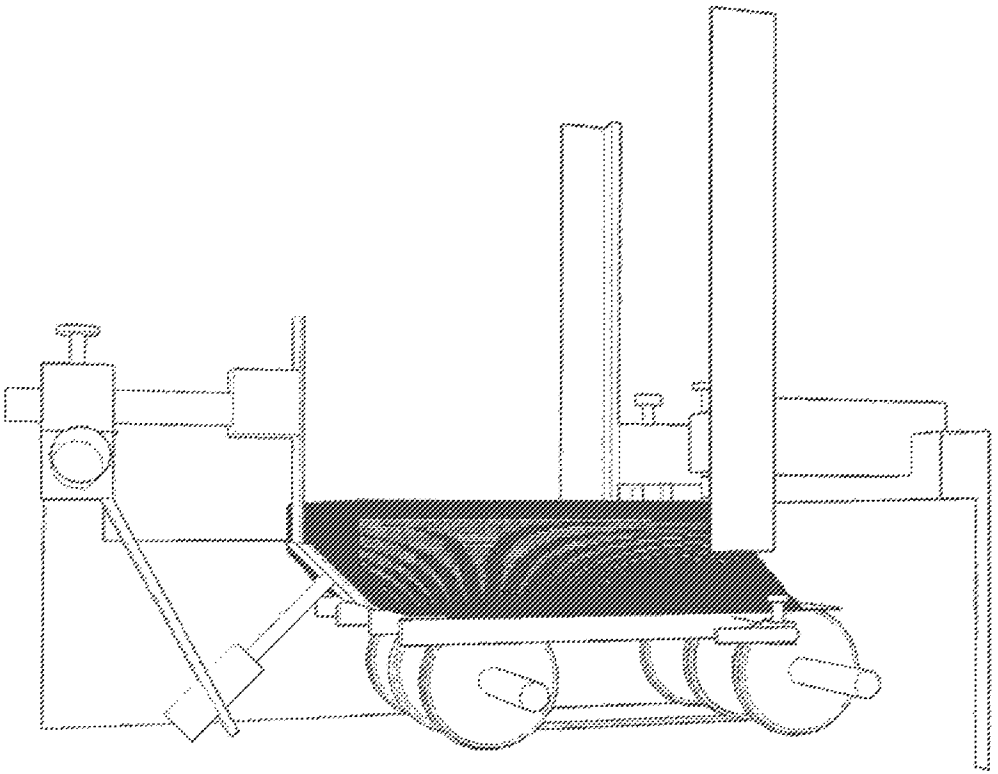
FIG. 2: representation of the feeder of FIG. 1 with a receiving device according to the disclosure and a knocking unit in a position in which the latter is transmitting a discrete knock impact onto an object stack deposited in the receiving device.

The knocking unit 3 includes a cylindrical housing 9 and a weight 5 that can be moved out of the housing 9. The weight 5 can be moved out of the housing 9 at high speed via a drive unit. The drive unit for the weight 5 can be a hydraulic or pneumatic drive, for example, or a motor drive such as an electric motor or a linear motor. The weight for the knocking unit 3 is shown in the retracted position in the representation of FIG. 1. The representation of FIG. 2 shows the weight 5 in the extended position. As can be seen from FIG. 2, the front end of the weight 5 strikes the rear side 2*b* of the stack shoe 2 in the extended position and thereby transmits a discrete knock impact onto the rear side 2*b* of the stack shoe 2 when the weight 5 is extended out of the housing 9. After transmitting a knock impact onto the stack shoe, the weight 5 is retracted into the housing 9 by a reverse motion and brought into its initial position.

Figure 8:
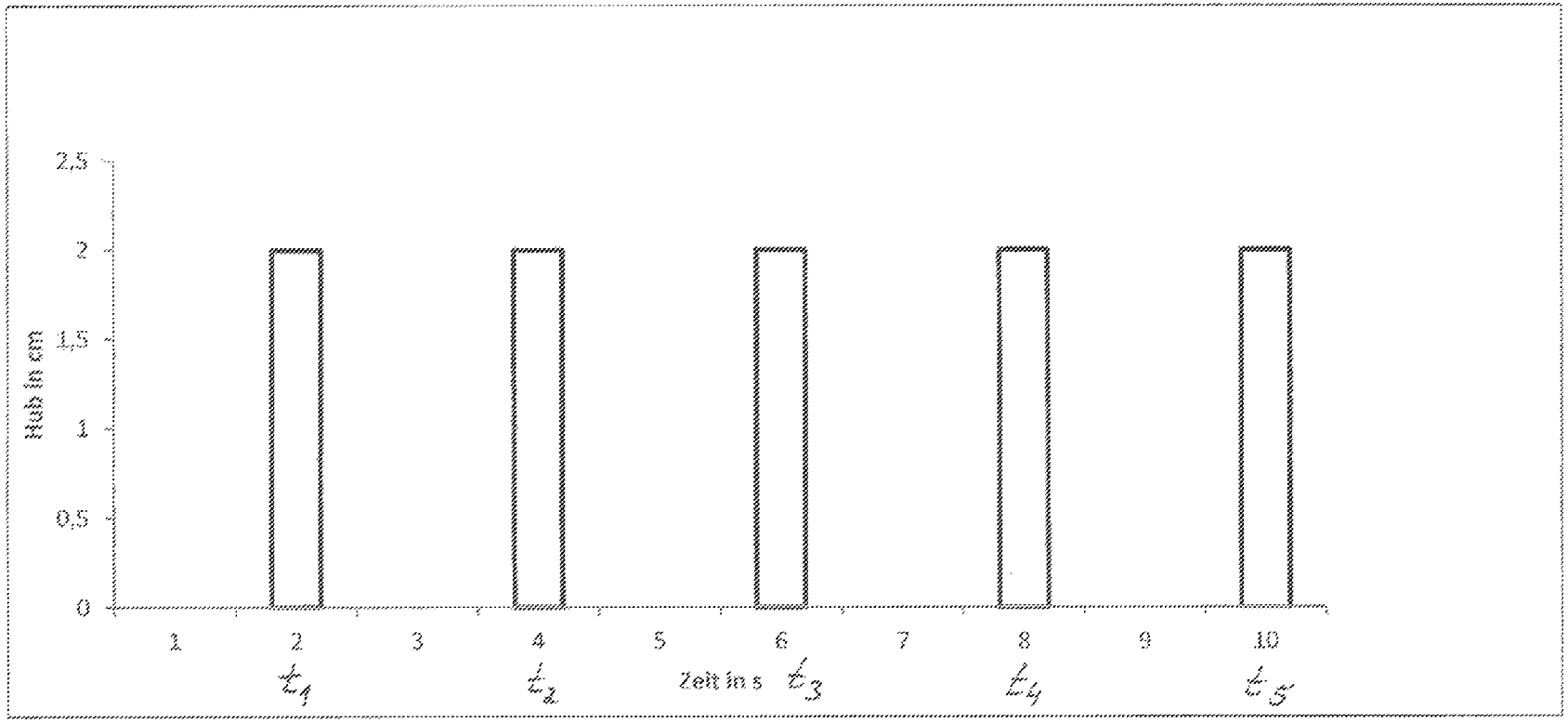
FIG. 8: diagram of the progression over time of the knocking unit stroke for a receiving device according to the disclosure.

The takeoff device 20 of the supplement feeder cyclically pulls individual objects G out of the stack S at a predetermined cycle frequency F (corresponding to the takeoff rate=number of objects taken off per unit time) and transports the taken-off objects farther in order to deposit them in collecting compartments of a combination line, for example. The knocking unit 3 is expediently controlled such that it transmits a discrete knocking impact to the stack shoe 2 continuously and at defined temporal intervals $\Delta t$. The defined temporal intervals are preferably equidistant. FIG. 8 shows a diagram that shows the stroke of the weight 5 as a function of time. At defined discrete points in time $t_1$, $t_2$, $t_3$, etc., the weight 5 is extended out of the housing 9 of the knocking unit and pressed against the rear side 2*b* of the stack shoe 2 in order to transmit a discrete knock impact onto the stack shoe 2.

The repetition rate $f=1/\Delta t$, with which the knocking unit 3 transmits discrete knock impacts onto the stack shoe 2, is expediently smaller than the cycle frequency F with which the takeoff device 10 takes objects G from the stack S. It has proved to be especially expedient if the repetition rate f is lower by a factor of 5-10 than the cycle frequency F, so that after every fifth or tenth takeoff of an object, for example, a discrete knock impact is transmitted to the stack shoe 2.

Figure 5:
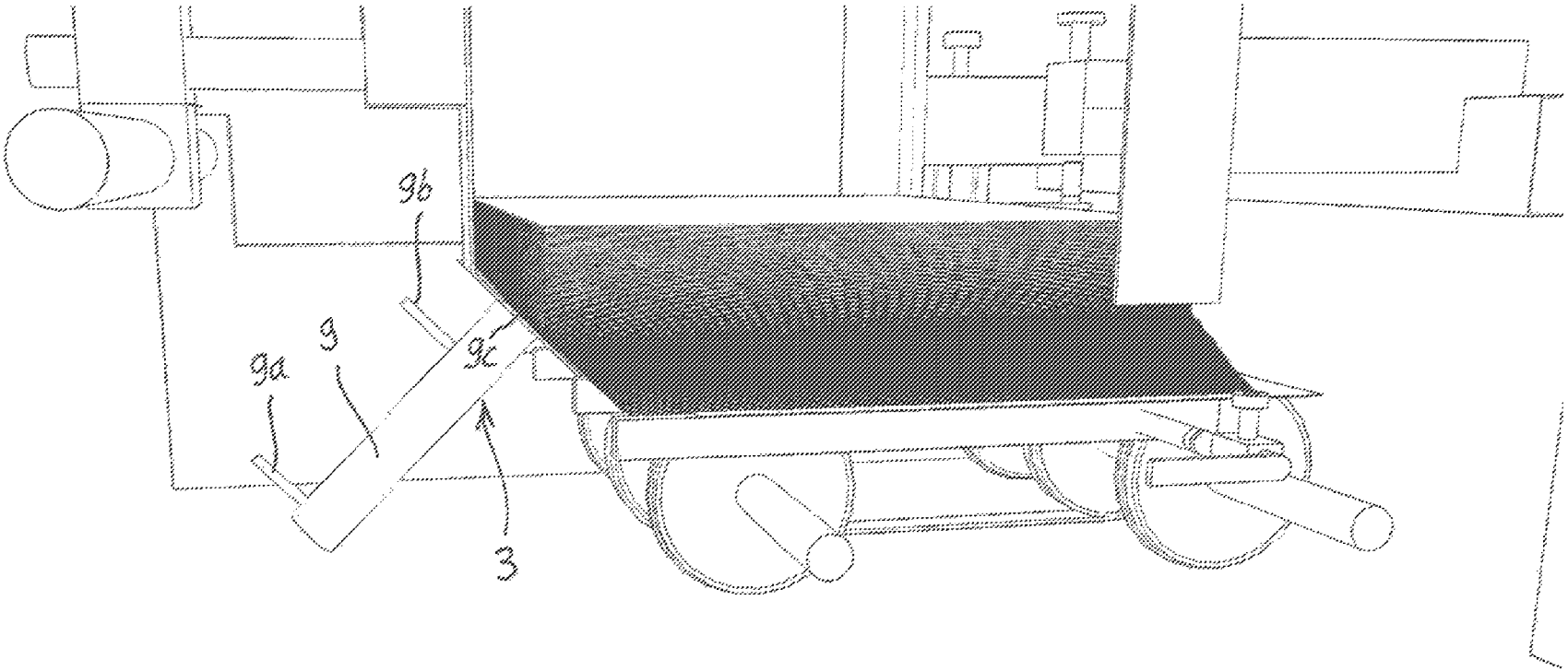
FIG. 5: perspective side view of a feeder with a receiving device according to the disclosure in a second embodiment.
Figure 6A:
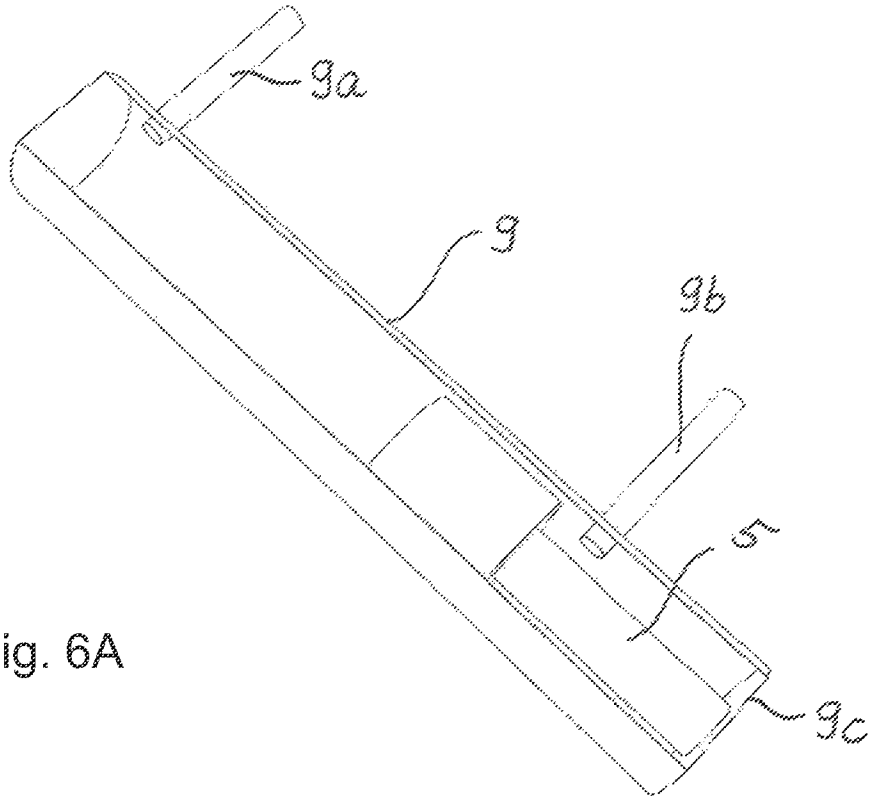
FIG. 6A: cutaway representation of a knocking unit for a receiving device according to the disclosure in an extended position.
Figure 6B:
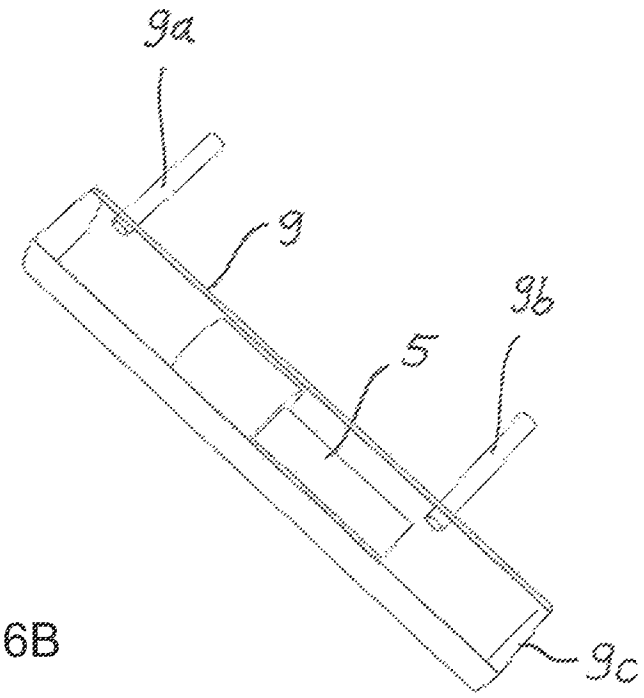
FIG. 6B: cutaway representation of a knocking unit for a receiving device according to the disclosure.

Another embodiment of a receiving device according to the disclosure is shown in FIG. 5. In this embodiment, the knocking unit 3 is fixed directly to the stack shoe 2. As can be seen in FIG. 5, the knocking unit 3 in the embodiment shown there is fixed to the rear side 2*b* of the stack shoe 2. The knocking unit 3 has a housing 9 in which a movable piston is arranged. FIGS. 6A and 6B show the knocking unit 3 in a cutaway view, so that the displaceably arranged piston 5 in the interior of the housing 9 can be seen. The housing 9 has a first connector 9*a* and a second connector 9*b*, to each of which compressed air or a hydraulic fluid can be applied. By injecting compressed air or hydraulic fluid into the first connector 9*a*, the piston 5 can be brought by means of a forward movement into the extended position shown in FIG. 6A. By injecting compressed air or hydraulic fluid through the second connector 9*b* and simultaneously opening the first connector 9*a*, the piston 5 can be brought back into its initial position shown in FIG. 6B. In the extended position shown in FIG. 6A, the front end of the piston 5 strikes against the front end face 9*c* of the housing 9, which is fixed to the rear side 2*b* of the stack shoe 2. By quickly extending the movable piston 5 into its extended position, the piston 5 generates a discrete knock impact on to the end wall 9*c* of the housing 9. This knock impact is first transmitted to the stack shoe 2 and from there onto the object stack S deposited in the stack compartment 1.

It has proved particularly expedient in this embodiment if the piston 5 is moved forward against the end wall 9*c* of the housing 9 at high speed by introducing compressed air or a hydraulic fluid under high pressure, and if the piston 5 is brought back to its original position with lower air or hydraulic pressure and therefore more slowly in its rearward movement. The rearward movement of the piston is thus expediently damped and therefore slower in comparison to the forward movement with which a discrete knock impact is transmitted to the stack shoe 2.

Figure 7A:
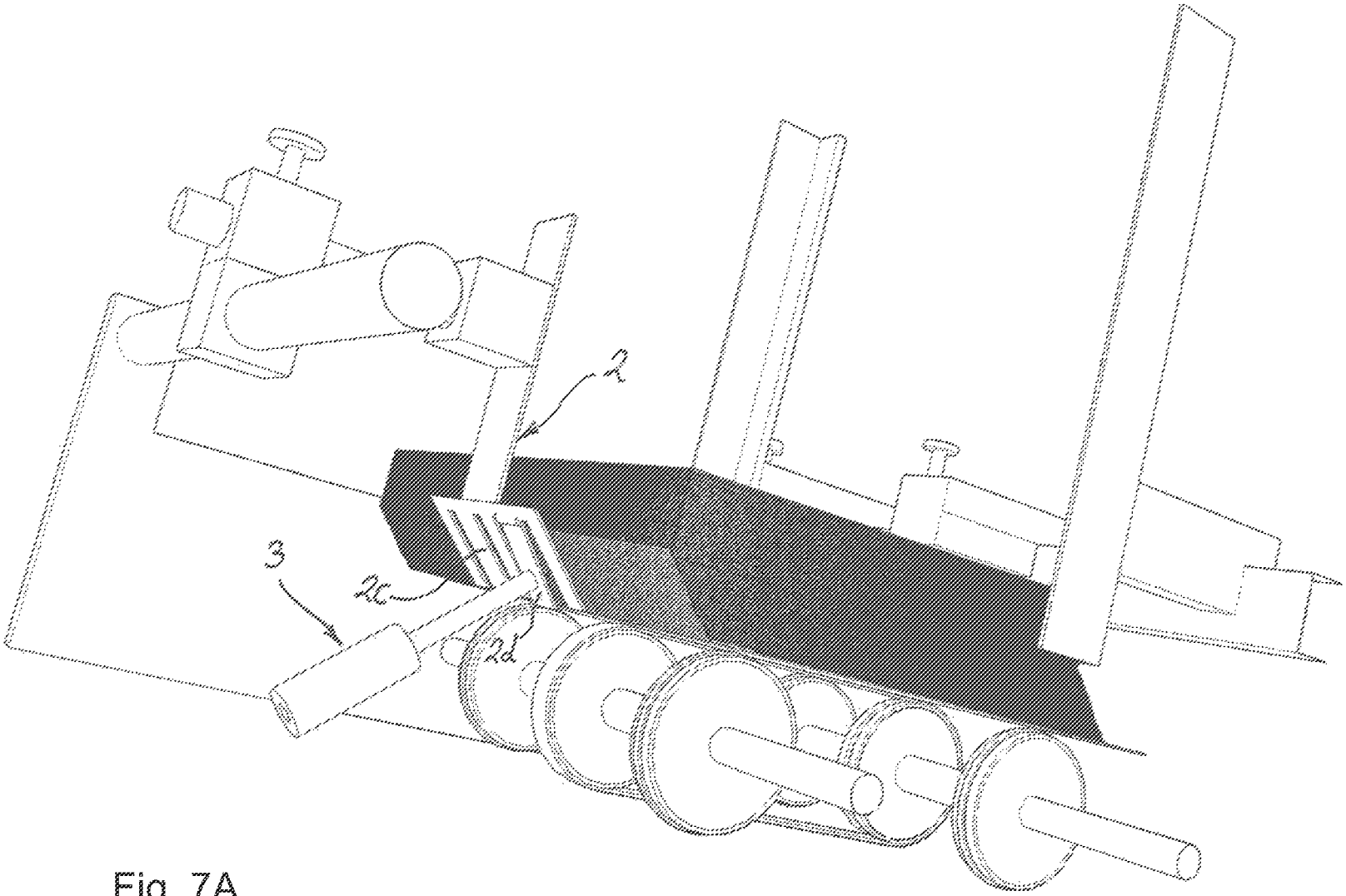
FIG. 7A: first perspective representation in a view from below of a feeder with a receiving device according to another embodiment of the disclosure.
Figure 7B:
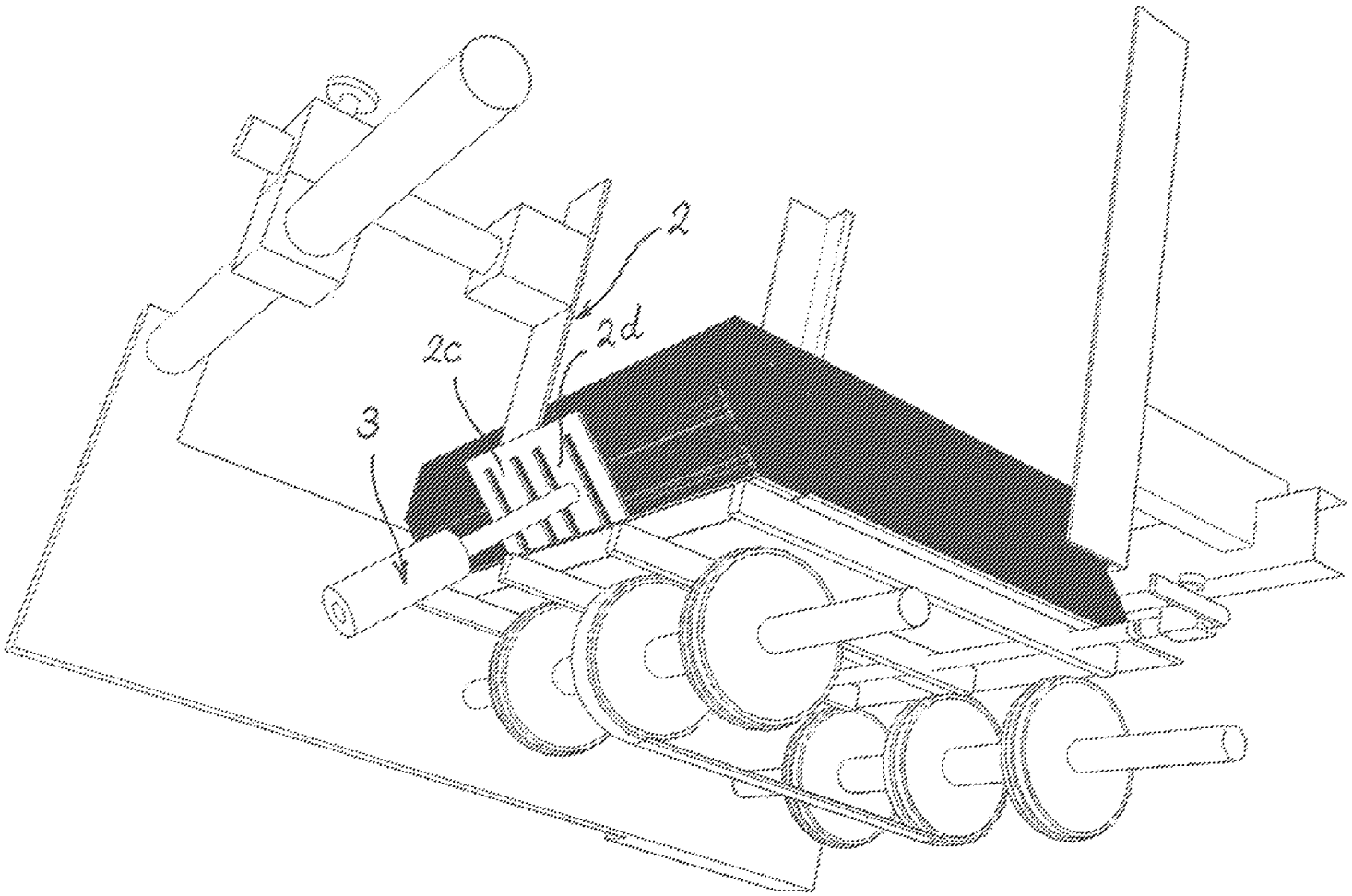
FIG. 7B: second perspective representation in a view from below of the feeder of FIG. 7A.
Figure 7C:
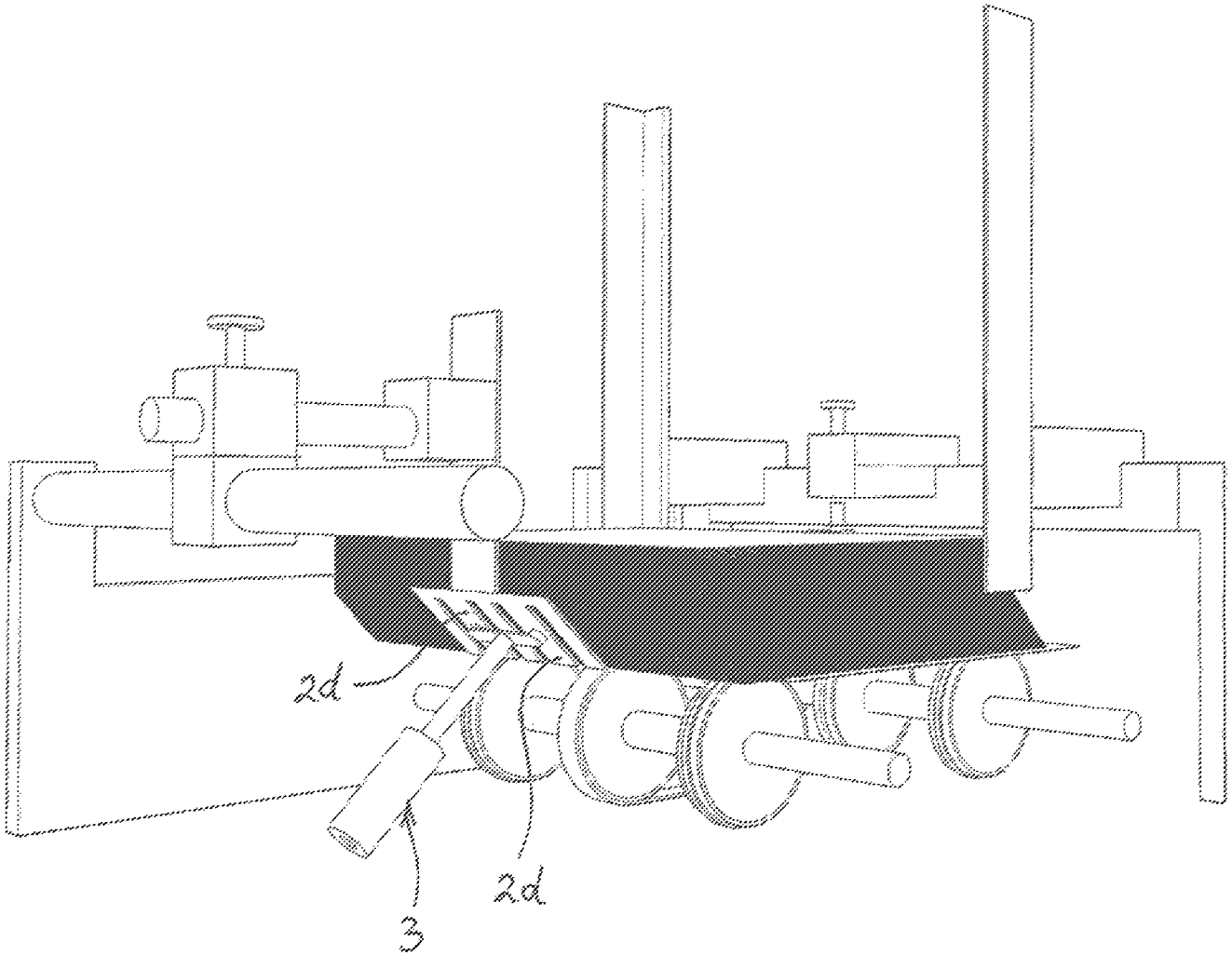
FIG. 7C: perspective representation in a view from below of a modification of the feeder of FIGS. 7A and 7B.

Another embodiment is shown in FIGS. 7A and 7B. In this example as well, the knocking unit 3 is fixed to the rear side 2*b* of the stack shoe 2. The stack shoe 2 in this embodiment has a grate-like stack plate 2*c*. This grate-like stack plate 2*c* contains a resilient arm 2*d*. The knocking unit 3 is coupled to this resilient arm 2*d*. The knocking unit 3 thereby transmits discrete knock impacts onto the resilient arm 2*d*, whereby the latter, as shown in the position of FIG. 7B, is pressed against the rear side H of the stack S and thereby transmits the knock impact to the stack S. A modification of this embodiment is shown in FIG. 7C. In this modified embodiment, the stack plate 2*c* contains two resilient arms 2*d*, each of which is connected to the knocking unit 3, so that the knocking unit 3 can transmit discrete knock impacts onto the resilient arms 2*d* and press them against the rear side H of the stack S.

The disclosure is not limited to the embodiments represented here. Thus, for example, the knocking unit 3 can also be connected to other components of the guiding elements, such as the guide rails 8, rather than to the stack shoe 2. The discrete knock impacts are then transmitted by the knocking unit 3 onto these components of the guiding elements and transmitted from there to the stack S. It is also possible to use multiple knocking units that are coupled to different components of the guiding elements 2, 8. It has proved particularly expedient to direct the discrete knock impacts onto the rear side 2*b* of the stack shoe 2 in the area of its inclined stack surface 2*a*. It is also possible, however, to transmit the knock impacts to a different point of the stack shoe 2.

The movable weight 5 of the knocking unit can be formed as piston movable in a housing, as illustrated here, or as a knocking hammer. Instead of carrying out a linear movement, the knocking unit 3 can also carry out a different movement, e.g. a (partially) circular movement, in order to move the movable weight 5 in the direction of a guiding element 2, 8.

What is claimed is:

1. A supplement feeder system for flat objects comprising:

a receiving device having a stack compartment for receiving a stack of flat objects; the stack compartment having a front contact region against which a front edge of the stack rests and the stack compartment further having a base on which the stack rests, the base adjustably inclined relative to a horizontal plane and the base is formed by a pivotable grate or a pivotable plate; and a takeoff device for removing individual flat objects from the stack, the takeoff device configured to take off the lowermost object from the stack with a predetermined cycle frequency F;

wherein the stack compartment has guiding elements for guiding and shaping the stack, the guiding elements comprising a stack shoe arranged at a rear edge of the stack to guide the stack in a direction of the front contact region of the stack compartment; and wherein at least one of the guiding elements is coupled with a knocking unit, the knocking unit transmitting a discrete knock impact onto the at least one of the guiding elements coupled thereto, the knocking unit configured to transmit a discrete knock impact onto the at least one of the guiding element coupled thereto with a predetermined repetition rate f which is smaller than the cycle frequency F with which the takeoff device is taking off objects from the stack.

2. The supplement feeder system according to claim 1, wherein the stack shoe has a stack surface inclined in a direction of the front contact region of the stack compartment, the stack surface supporting rear edges of lowermost objects on the stack.

3. The supplement feeder system according to claim 1, wherein the guiding elements comprise guide rails arranged in the front contact region of the stack compartment, the guide rails forming a stop for a front edge of uppermost objects on the stack.

4. The supplement feeder system according to claim 1, wherein the knocking unit has a movable weight which is movable against the at least one of the guiding elements coupled with the knocking unit.

5. The supplement feeder system according to claim 4, wherein the movable weight is a movable piston, the piston movable against a rear side of the stack shoe.

6. The supplement feeder system according to claim 1, wherein the knocking unit is fixed to a rear side of the stack shoe.

7. The supplement feeder system according to claim 1, wherein the knocking unit has a housing fixed to the at least one of the guiding elements coupled with the knocking unit, and wherein a pneumatically-driven, hydraulically-driven, or motor-driven piston is movably arranged in the housing of the knocking unit.

8. The supplement feeder system according to claim 1, wherein the stack shoe includes at least one resilient arm coupled to the knocking unit arranged such that the knocking unit transmits the discrete knock impact onto the at least one resilient arm, thereby pressing the at least one resilient arm against the stack.

9. The supplement feeder system according to claim 1, wherein:

the front contact region of the receiving device has a contact surface running vertically to the stack and an inclined surface adjoining the contact surface running parallel to the stack, the inclined surface extending in a direction of a bottom of the stack compartment.

10. A supplement feeder for flat objects comprising:

a receiving device having a stack compartment for receiving a stack of flat objects; the stack compartment having a front contact region against which a front edge of the stack rests and the stack compartment further having a base on which the stack rests, the base adjustably inclined relative to a horizontal plane and the base is formed by a pivotable grate or a pivotable plate;

a takeoff device for removing a lowermost object from the stack, the takeoff device including a conveying element with a conveying surface, the conveying element pulling the lowermost object lying on its conveying surface out of the stack and transporting it along a takeoff direction; and a gate element having a forward-inclined oblique surface, the forward-inclined oblique surface forming a stop surface relative to the conveying surface of the conveying element for a front edge of lower objects of the stack, thereby forming a wedge-shaped offsetting of the lower objects in the stack;

wherein the stack compartment has guiding elements for guiding and shaping the stack, the guiding elements comprising a stack shoe arranged at a rear edge of the stack to guide the stack in a direction of the front contact region of the stack compartment; and wherein at least one of the guiding elements is coupled with a knocking unit, the knocking unit configured to transmit a discrete knock impact onto the at least one of the guiding elements coupled thereto.

11. A method for separating an individual object from a stack of objects, the method comprising the steps of:

placing the stack of objects in the stack compartment of the receiving device of the supplement feeder of claim 10;

pulling the lowermost object out of the stack using the takeoff device; and transmitting a discrete knock impact onto the at least one of the guiding elements, wherein the discrete knock impact loosens the objects resting atop each other in the stack, thereby reducing errors in pulling the individual object from the stack.

12. The method for separating an individual object from a stack of objects according to claim 11, wherein the step of transmitting includes transmitting the discrete knock impact onto the at least one of the guiding elements at defined points in time, the defined points in time equidistant from each other and defining the repetition rate f being an inverse of equidistance ΔT between succeeding points in time.

13. The method for separating an individual object from a stack of objects according to claim 11, wherein the step of transmitting includes transmitting the discrete knock impact onto the at least one of the guiding elements at defined points in time, the defined points in time equidistant from each other and having a temporal interval (ΔT) of 0.1-10 seconds between one another.

14. The method for separating an individual object from a stack of objects according to claim 11, wherein the repetition rate f is lower than the cycle frequency F by a factor of 5-10.

15. The method for separating an individual object from a stack of objects according to claim 11, wherein the step of transmitting a discrete knock impact onto the at least one of the guiding elements includes using a piston carrying out a forward movement from an original position in order to transmit the discrete knock impact to the at least one of the guiding elements and resetting the piston with a driven return movement to the original position of the piston.

16. The method for separating an individual object from a stack of objects according to claim 15, wherein, during the step of transmitting using a piston, the drive return movement is dampened in comparison to the forward movement such that the driven return movement is slower than the forward movement.

* * * * *